US012521783B2

(12) United States Patent
Maurer et al.

(10) Patent No.: US 12,521,783 B2
(45) Date of Patent: Jan. 13, 2026

(54) SYSTEM FOR DYNAMICALLY ADJUSTING POSITIONING OF A TOOLPACK OF A CAN BODYMAKER AND CAN BODYMAKER INCLUDING SAME

(71) Applicant: Stolle Machinery Company, LLC, Centennial, CO (US)

(72) Inventors: Joseph John Allen Maurer, Aurora, CO (US); Stephen Dane Christensen, Highlands Ranch, CO (US); Ian Kenneth Scholey, Tankersley (GB)

(73) Assignee: Stolle Machinery Company, LLC, Centennial, CO (US)

( * ) Notice: Subject to any disclaimer, the term of this patent is extended or adjusted under 35 U.S.C. 154(b) by 293 days.

(21) Appl. No.: 18/485,723

(22) Filed: Oct. 12, 2023

(65) Prior Publication Data

US 2024/0123488 A1 Apr. 18, 2024

Related U.S. Application Data

(60) Provisional application No. 63/420,355, filed on Oct. 28, 2022, provisional application No. 63/416,190, filed on Oct. 14, 2022.

(51) Int. Cl.
*B21D 51/26* (2006.01)
*B21D 22/28* (2006.01)

(52) U.S. Cl.
CPC ..... *B21D 51/26* (2013.01); *B21D 22/28* (2013.01); *B21D 22/283* (2013.01); *B21D 51/2692* (2013.01); *B21D 51/2653* (2013.01)

(58) Field of Classification Search
CPC .... B21D 24/005; B21D 22/28; B21D 22/283; B21D 22/30; B21D 51/26; B21D 51/2692
See application file for complete search history.

(56) References Cited

U.S. PATENT DOCUMENTS 3,771,345 A 11/1973 Paramonoff
3,886,781 A 6/1975 Paramonoff et al.
(Continued)

FOREIGN PATENT DOCUMENTS

DE 112004001484 B4 3/2011
JP 6263560 B2 1/2018
(Continued)

OTHER PUBLICATIONS

U.S. Patent and Trademark Office, U.S. Appl. No. 18/485,582 Office Action, Sep. 3, 2025 , 27 pages.
(Continued)

*Primary Examiner* — Bobby Yeonjin Kim
(74) *Attorney, Agent, or Firm* — Eckert Seamans Cherin & Mellott, LLC

(57) ABSTRACT

A toolpack arrangement for a can bodymaker having a frame. The toolpack includes a toolpack having a number of forming dies and an adjustment arrangement. The adjustment includes a number of adjustment mechanisms coupled between the toolpack and the frame, each adjustment mechanism being dynamically adjustable so as to selectively adjust the positioning of the toolpack with regard to the frame and/or a ram body of the can bodymaker as the ram body passes within the toolpack during normal can body making operations of the can bodymaker.

14 Claims, 15 Drawing Sheets

(56) References Cited

U.S. PATENT DOCUMENTS

| | | | | |
|---|---|---|---|---|
| 3,943,740 | A | 3/1976 | Bartenstein | |
| 4,007,620 | A | 2/1977 | Urban | |
| 4,546,636 | A | 10/1985 | Snyder et al. | |
| 5,016,462 | A | 5/1991 | Grims et al. | |
| 5,272,902 | A | 12/1993 | Kobak | |
| 5,487,295 | A | 1/1996 | Diekhoff et al. | |
| 6,047,587 | A | 4/2000 | Naggert | |
| 7,124,613 | B1 | 10/2006 | McClung | |
| 8,713,980 | B2 | 5/2014 | Fleischer et al. | |
| 8,869,578 | B2 | 10/2014 | Fleischer et al. | |
| 9,016,101 | B2 | 4/2015 | Pick et al. | |
| 9,079,237 | B2 | 7/2015 | Fleischer et al. | |
| 9,387,530 | B2 | 7/2016 | Fowler et al. | |
| 10,434,558 | B2 | 10/2019 | Sines | |
| 10,864,568 | B2 | 12/2020 | Swedberg | |
| 2006/0225479 | A1 | 10/2006 | Zauhar | |
| 2012/0304720 | A1* | 12/2012 | Fleischer | B21D 43/003 72/20.1 |
| 2018/0071809 | A1 | 3/2018 | Butcher et al. | |
| 2019/0232351 | A1 | 8/2019 | Rukat | |
| 2019/0240717 | A1* | 8/2019 | Rukat | B21D 22/286 |
| 2019/0262884 | A1 | 8/2019 | Rukat | |

FOREIGN PATENT DOCUMENTS

| | | | |
|---|---|---|---|
| JP | 2018020380 | A | 2/2018 |
| WO | 2008068169 | A1 | 6/2008 |

OTHER PUBLICATIONS

Delta-H Technology Ltd., Free Stroke Analyser "Get the latest version of the software User's Manual download", revised Jun. 2019, 4 pp.

Delta-H Technology Ltd., Free Stroke Analyser, Verision 2.09, Sep. 2014, "User's Manual". Revision date: Sep. 23, 2014, 38 pp.

Delta-H Technology Ltd., Free Stroke Analyser, "Software and Gauge Equipment for the Measurement of Bodymaker Alignment", Copyright 2006, 2 pp.

International Searching Authority, U.S. Patent and Trademark Office, PCT Application No. PCT/US23/76689, International Search Report and Written Opinion, Feb. 6, 2024, 13 pages.

* cited by examiner

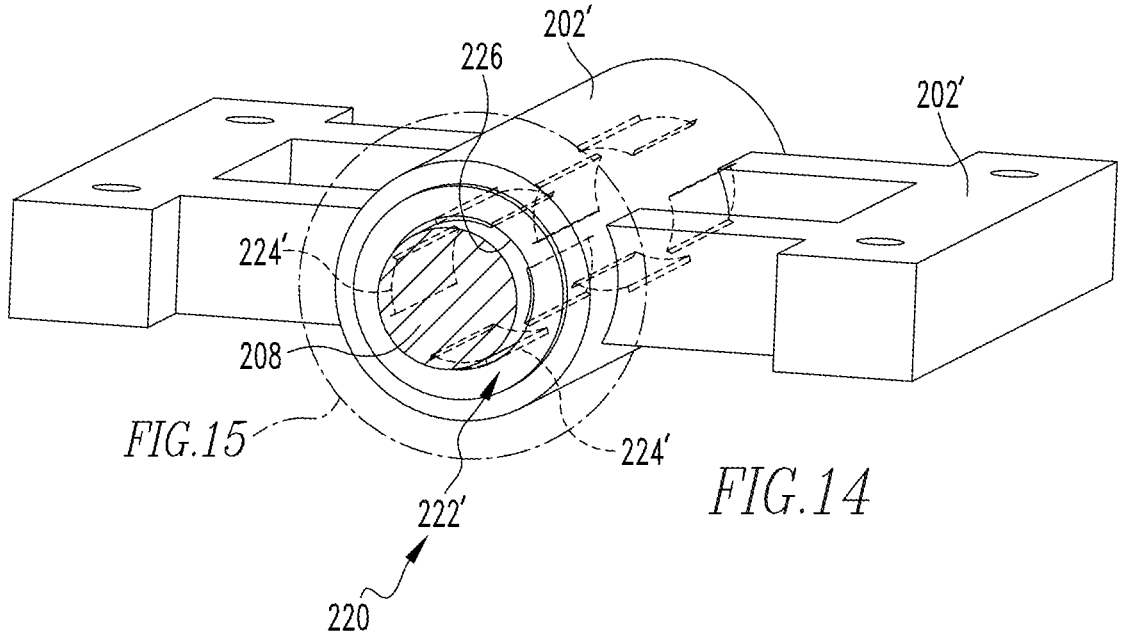
FIG.15
FIG.14
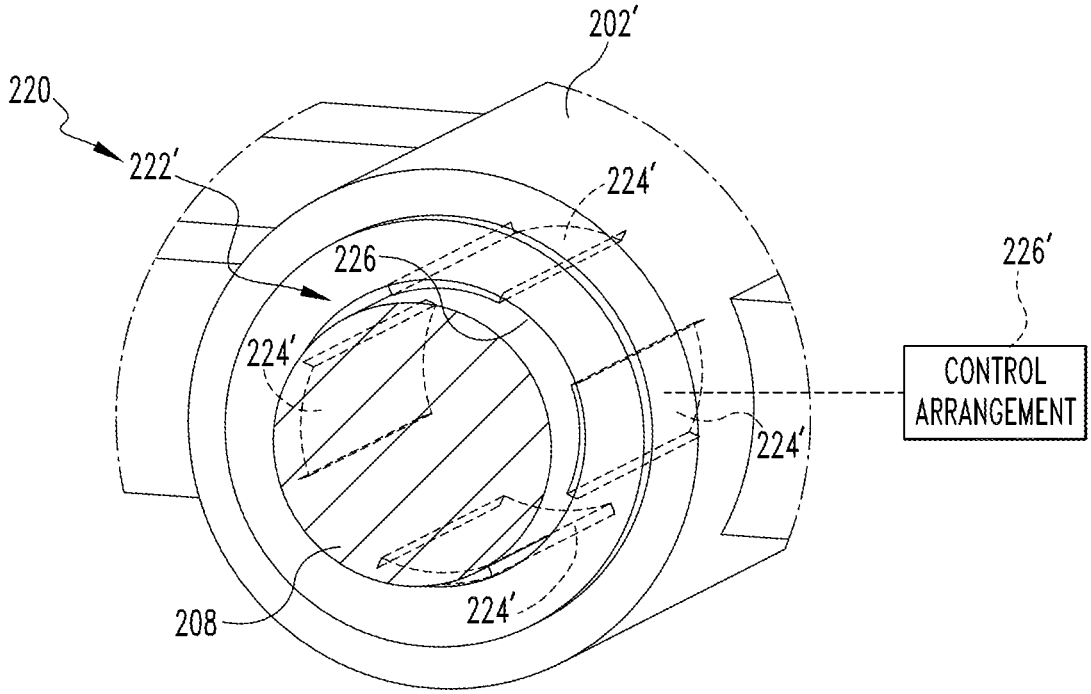
FIG.15

SYSTEM FOR DYNAMICALLY ADJUSTING POSITIONING OF A TOOLPACK OF A CAN BODYMAKER AND CAN BODYMAKER INCLUDING SAME

CROSS REFERENCE TO RELATED APPLICATIONS

This application is claims priority to U.S. Provisional Patent Application Ser. No. 63/420,355, filed Oct. 28, 2022, titled "SYSTEM FOR DYNAMICALLY ADJUSTING POSITIONING OF A TOOLPACK OF A CAN BODYMAKER INCLUDING SAME" and to U.S. Provisional Patent Application Ser. No. 63/416,190, filed Oct. 14, 2022, titled "SYSTEM FOR SENSING AND DYNAMICALLY ADJUSTING POSITIONING OF ONE OR MORE COMPONENTS WITHIN A CAN BODYMAKER AND CAN BODYMAKER INCLUDING SAME".

FIELD OF THE INVENTION

The disclosed concept relates generally to machinery and, more particularly, to can bodymakers for producing can bodies used in the food and beverage packaging industries. More particularly, the disclosed concept relates to arrangements for sensing and adjusting the positioning of one or more components within a can bodymaker such as a toolpack of a can bodymaker. The disclosed concept further relates to systems utilizing such arrangements for sensing and dynamically adjusting the positioning of one or more components such as a toolpack within a can bodymaker as well as can bodymakers including the same.

BACKGROUND OF THE INVENTION

Generally, an aluminum can begins as a sheet of aluminum from which a circular blank is cut. The blank is formed into a "cup" having a bottom and a depending sidewall. The cup is fed into a can bodymaker which passes the cup through a toolpack that thins and elongates the cup, thus forming a can body. That is, the cup is disposed on a punch mounted on an elongated ram. The ram is structured to reciprocate and pass the cup through the toolpack which (re)draws and irons the cup. That is, on each forward stroke of the ram, a cup is passed through the toolpack which forms the cup into the can body. Near the start of the return stroke, the now elongated can body is removed from the ram prior to the punch passing backward through the toolpack. A new cup is disposed on the punch prior to the punch passing forward again through the toolpack. Following additional finishing operations, e.g. trimming, washing, printing, etc., each can body is sent to a filler which fills the can body with product. A top is then coupled to, and sealed against, the can body, thereby completing the can.

The toolpack in the can bodymaker has multiple, spaced dies, each die having a substantially circular opening. Each die opening is slightly smaller than the next adjacent upstream die. Thus, when the punch draws the cup through the first die, the redraw die, the aluminum cup is deformed over the substantially cylindrical punch. Because the openings in the subsequent downstream dies of the toolpack have a smaller inner diameter, i.e. a smaller opening, the aluminum cup is thinned as the ram moves the punch and aluminum cup thereon through the rest of the toolpack. The space between the ram and the redraw die is typically less than about 0.010 inch and less than about 0.004 inch in the last ironing die.

After the cup (now generally in the shape of the can body) has moved through the last die, the cup bottom and sidewall have the desired thickness; the only other deformation required is to shape the bottom of the cup into an inwardly extending (i.e., concave) dome. To accomplish this, the distal end of the punch is concave while at the maximum extension of the ram is a generally convex dome element (having a shaped perimeter) commonly referred to as a "domer." As the ram reaches its maximum extension, the bottom of the can body engages the domer and is deformed into a dome and the bottom perimeter of the can body is shaped as desired (typically angled inwardly so as to increase the strength of the can body and to allow for the resulting cans to be stacked). As the ram withdraws, the can body is stripped off of the end of the punch by injecting air into the center of the ram. The air travels through the ram and exits out of the end of the punch and breaks the can body loose from the punch. Typically, there is also a mechanical stripper, which prevents the can body from staying on the punch as it retracts back through the toolpack. The ram is withdrawn through the toolpack, a new cup is deposited on the punch, and the cycle repeats.

The ram and toolpack are typically oriented generally horizontally. This orientation, however, allows for wear and tear on the ram. That is, the dies in the toolpack must be separated so as to allow for the proper deformation of the blank/cup. This means that the ram must extend horizontally through the entire toolpack, a distance that is typically between 18 and 30 inches, with the stroke length (i.e., the distance the punch must travel) for the bodymaker being slightly larger. This means that the ram is, essentially, a cantilevered arm. As is known, even a very rigid member supported as a cantilever will droop at the distal end. While this droop is generally not a problem for stationary members, the droop is a problem for a reciprocating punch/ram passing through a number of dies with a radial clearance of less than about 0.004 inch. In order to compensate for the droop of the punch/ram, the toolpack, domer and stripper are typically each statically aligned to the punch/ram prior to operation of the bodymaker. This process is very critical as misalignment between the punch and die(s) within the toolpack can result in the can/container to have defects, to cause the material to tear, and/or damage the punch and die(s). However, such static alignment(s) may not be correct for the dynamics of the moving ram/punch when the bodymaker is in operation producing can bodies. Also, there are other factors (e.g., without limitation, thermal growth) that can cause the punch not to run concentrically to the centerline of the dies of the toolpack. Thus, because of the droop and other reasons, the ram/punch may not be concentric with the circular dies of the toolpack during operation of the bodymaker, e.g., ram/punch is closer to, or in contact with, the lower portion of the die due to droop thus causing mis-formed, un-useable can bodies and over time premature wear and/or other damage to one or both of the punch and/or the dies of the toolpack. Similarly, thermal and/or other effects can result in the ram/punch being off center in any direction thus causing mis-formed, un-useable can bodies and over time premature wear and/or other damage to one or both of the punch and/or the dies of the toolpack. When any of these damaging events occur, the damaged parts must be replaced. Further, because replacement of such parts is a time consuming procedure, and because a typical can bodymaker produces over 15,000 cans an hour, having a misaligned punch/ram is a disadvantage. That is, if the ram/punch is misaligned, it is unlikely that any acceptable cans will be made. Hence, the ram/punch should be aligned to the centerline of the toolpack (both horizontally and vertically) at all times.

In conventional arrangements, in order to verify that acceptable cans are being formed, the can bodymaker is periodically stopped so that measurements of specific can bodies can be carried out, particularly the thicknesses thereof around the circumference of several can bodies. From such measurements determinations of adjustments needed to the forming elements (e.g., ram/punch, toolpack, etc.) and/or the need for replacement of worn parts can be made. Such adjustments and/or part replacement(s) are then carried out and the machine is placed back into operation. The time needed for carrying out such stoppage(s) for measuring cans and adjusting the alignment of, or replacing, components of the bodymaker is time the bodymaker is not producing cans for use and thus is a disadvantage. Thus, a stated problem with the known systems and methods for aligning a punch/ram with a toolpack and/or other components of a can bodymaker is that the known systems and methods do not detect the position of the punch/ram in motion and/or details of the can body formed thereon from the passing of the punch through the toolpack nor provide for the dynamic adjustment of the positioning of components of the can bodymaker to correct for any misalignment (s).

SUMMARY OF THE INVENTION

As one aspect of the disclosed concept, a toolpack arrangement for a can bodymaker having a frame is provided. The toolpack arrangement comprises: a toolpack having a number of forming dies; and an adjustment arrangement comprising a number of adjustment mechanisms structured to be coupled between the toolpack and the frame, each adjustment mechanism being structured to dynamically selectively adjust the positioning of the toolpack with regard to the frame and/or a ram body of the can bodymaker as the ram body passes within the toolpack during normal can body making operations of the can bodymaker.

The adjustment arrangement may further comprise a controller in communication with each adjustment mechanism of the number of adjustment mechanisms, the controller may be structured to selectively control each adjustment carried out by the number of adjustment mechanisms. The toolpack may further comprise a sensing arrangement in communication with the controller, the sensing arrangement may include a number of sensors structured to detect the position of a number of components of the bodymaker, and the controller may be structured to selectively control each adjustment carried out by the number of adjustment arrangements based at least in-part from input received from the number of sensors.

The number of adjustment mechanisms may comprise a plurality of adjustment mechanisms.

The toolpack arrangement may further comprise a cradle supporting the toolpack, and the number of adjustment mechanisms may be coupled to the toolpack via the cradle.

The number of adjustment mechanisms may be driven by one or more of a mechanical, pneumatic, electrical and/or a hydraulic means.

Each adjustment mechanism of the plurality of adjustment mechanisms may be driven by one or more of a mechanical, pneumatic, electrical and/or a hydraulic means.

As another aspect of the disclosed concept a can bodymaker for forming a plurality of can bodies is provided. The can bodymaker comprises: a frame; a ram; an operating mechanism structured to provide a reciprocating motion to the ram; and a toolpack arrangement comprising: a toolpack having a number of forming dies positioned such that the ram passes therewithin when provided with the reciprocating motion by the operating mechanism; and an adjustment arrangement comprising a number of adjustment mechanisms coupled between the toolpack and the frame, each adjustment mechanism being dynamically adjustable so as to selectively adjust the positioning of the toolpack with regard to the frame and/or the ram as the ram passes within the toolpack during normal can body making operations of the can bodymaker.

The adjustment arrangement may further comprise a controller in communication with each adjustment mechanism of the number of adjustment mechanisms, wherein the controller is structured to selectively control each adjustment carried out by the number of adjustment mechanisms.

The adjustment arrangement may further comprise a sensing arrangement in communication with the controller, the sensing arrangement may include a number of sensors structured to detect the position of a number of components of the bodymaker, and the controller may be structured to selectively control each adjustment carried out by the number of adjustment mechanisms based at least in part from input received from the number of sensors.

The number of adjustment mechanisms may comprise a plurality of adjustment mechanisms.

The can bodymaker may further comprise a cradle supporting the toolpack, and the number of adjustment mechanisms may be coupled to the toolpack via the cradle.

The number of adjustment mechanisms may be driven by one or more of a mechanical, pneumatic, electrical and/or a hydraulic means.

Each adjustment mechanism of the plurality of adjustment mechanisms are driven by one or more of a mechanical, pneumatic, electrical and/or a hydraulic means.

These and other objects, features, and characteristics of the disclosed concept, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are provided for the purpose of illustration and description only and are not intended as a definition of the limits of the concept.

BRIEF DESCRIPTION OF THE DRAWINGS

A full understanding of the disclosed concept can be gained from the following description of the preferred embodiments when read in conjunction with the accompanying drawings in which:

FIG. 14 is a perspective view of the carriage of the portion of the ram assembly of FIG. 13 shown with a portion of the ram body positioned in a cylindrical aperture of the carriage;

FIG. 15 is a detail view of a portion of the view of FIG. 14 as indicated in FIG. 14;

DETAILED DESCRIPTION OF THE INVENTION

Figure 1:
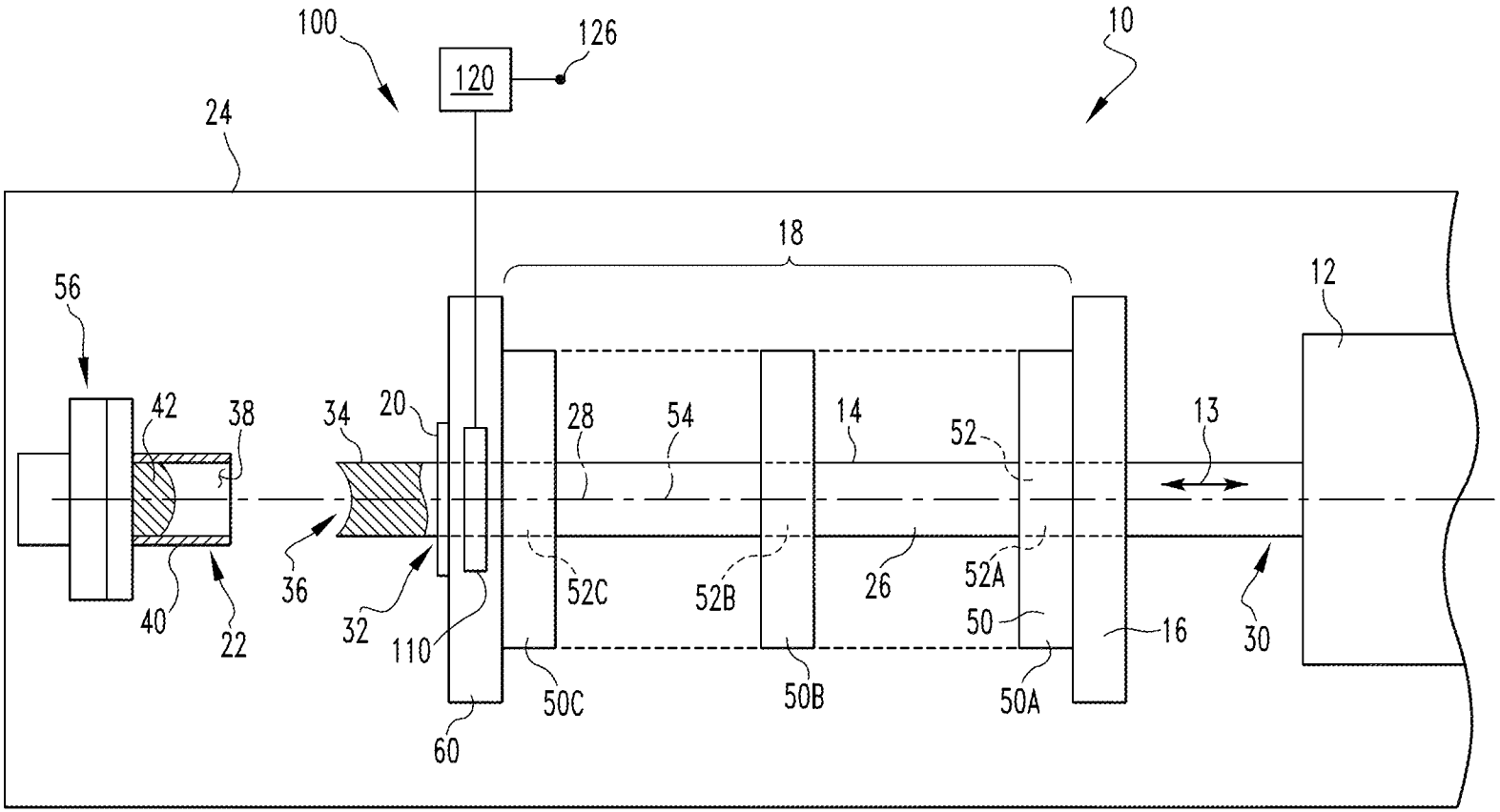
FIG. 1 is a schematic cross-sectional view of a can bodymaker in accordance with an example embodiment of the disclosed concept.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the term "can" refers to any known or suitable container, which is structured to contain a substance (e.g., without limitation, liquid; food; any other suitable substance), and expressly includes, but is not limited to, beverage cans, such as beer and soda cans, as well as cans used for food.

As used herein, a "target position" is a selected position for a component relative to one or more other component(s).

As used herein, "dynamically positioning" means positioning a component relative to one or more other component(s) based on measurements acquired when the punch of a can forming machine is in motion. This would include adjusting the component while the punch is in motion as well as when the punch is motionless, so long as the measurements are acquired when the punch is in motion.

As used herein, "actively positioning" means positioning a component relative to one or more other component(s) when the punch is in motion.

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are coupled in direct contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire.

As used herein, "engage," when used in reference to gears or other components having teeth, means that the teeth of the gears interface with each other and the rotation of one gear causes the other gear to rotate as well.

As employed herein, the term "number" shall mean one or an integer greater than one (i.e., a plurality).

As used herein, "normal operation" of a bodymaker shall mean operating the bodymaker in a full production mode over an extended period of time with the intention of producing an optimum volume of can bodies for the particular bodymaker over such time.

As used herein, an "electromagnetic adjustment arrangement" is an arrangement for adjusting the positioning of an element or elements that utilizes controlled electromagnetic forces to control/adjust the positioning.

As used herein, a "thermodynamic adjustment arrangement" is an arrangement for adjusting the positioning of an element of elements that utilizes temperature and changes thereto to control/adjust the positioning.

As shown schematically in FIG. 1, a can bodymaker, or can forming machine, 10 in accordance with an example embodiment of the disclosed concept includes an operating mechanism 12 structured to provide a cyclical and/or reciprocating motion (such as shown by the double-headed arrow 13), a ram 14, a load station 16, a die assembly, or toolpack, 18, a can stripper 20, and a domer assembly 22. In the example embodiment shown in FIG. 1, each of the aforementioned components are coupled, directly or indirectly, to a frame, or housing (shown generally as 24), for maintaining such components, and/or selected portions thereof, in a known relationship with respect to one or more of the other of such components.

Continuing to refer to FIG. 1, the ram 14 has an elongated, substantially cylindrical ram body 26 positioned about a longitudinal axis 28 such that ram 14 moves back and forth generally along longitudinal axis 28. The ram body 26 includes a proximal end 30 positioned nearest, and coupled to the operating mechanism 12, and a distal end 32 positioned opposite proximal end 30. A punch 34 is disposed at, or over, the distal end 32 of the ram 14. The punch 34 is a generally cylindrical body with a concave distal end 36 which may be shaped to correspond to a cavity 38 of a domer die 40 of the domer assembly 22. The operating mechanism 12 provides a reciprocal motion to the ram body 26 causing the ram body 26, and therefore the punch 34, to move back and forth along its longitudinal axis 28. That is, the punch 34 is structured to reciprocate between a retracted position, wherein the punch 34 is positioned between the load station 16 and the operating mechanism 12, and an extended position, wherein the ram body extends generally horizontally through the toolpack 18 and the distal end 36 of the punch 34 is disposed adjacent to, and indirectly engaged with via a bottom of a can body positioned on the punch 34, a convex dome formation 42 provided as a portion of, and extending into the cavity 38 thereof, the domer die 40 of the domer assembly 22.

The toolpack 18 includes a number (e.g., without limitation, three are shown in the example) of die(s) 50 (each) having an opening 52 therein. The opening 52A in the first die 50A (the die 50 closest to the operating mechanism 12) is slightly larger than the opening 52B in the second (middle, as shown) die 50B. The opening 52B in the second die 50B is slightly larger than the opening 52C in the third (farthest from the operating mechanism 12) die 50C. That is, in one example embodiment, the opening 52A in the first die 50A has a radius that is about 0.010 inch larger than the radius of the punch 34, the opening 52B in the second die 50B has a radius that is about 0.007 inch larger than the radius of the punch 34, and the opening 52C in the third die 50C has a radius that is about 0.004 inch larger than the radius of the punch 34. The opening(s) 52 of the die(s) 50 are disposed along a common axis 54 that is generally aligned with the longitudinal axis 28 of the ram body 26.

In the configuration shown in FIG. 1, the can bodymaker 10 is structured to transform a cup into a can body, which may later have a top added, forming a can. A cup is disposed on/over the punch 34 by the load station 16 prior to the punch 34 passing forward through the toolpack 18 moving from the retracted position to the extended position such as previously discussed. When the punch 34 pushes the cup through the toolpack 18, ideally the cup is thinned and stretched to a desired length and wall thickness if the opening(s) 52 of the die(s) 54 of the die pack 18 are properly aligned with the path of the punch 34. The elongated cup is a can body.

The domer assembly 22 is disposed at the end of the stroke of the ram body 26. The domer assembly 22 includes the domer die 40 that is coupled to the frame 24 of the can bodymaker 10 by a mounting assembly 56 which may be of any suitable arrangement. In an example embodiment of the disclosed concept, mounting assembly 56 is arranged in a manner similar to that disclosed in U.S. Pat. No. 8,713,980, the contents of which are incorporated herein by reference, such that the positioning of domer die 40 can be dynamically adjusted (discussed below). The domer die 40 is a body 44 with the cavity 38 defining the convex dome formation 42. The cavity 38 may include other features structured to shape the bottom of the cup. Ideally, the center of the dome formation 42 is substantially aligned with the longitudinal axis 28 of the ram body 26. In such arrangement, when the ram body 26 is at its maximum extension, i.e., in the extended position previously discussed, the cup bottom, that portion of the cup covering the concave distal end 36 of the punch 34, is shaped by the punch 34 entering the cavity 38 of the domer die 40. That is, the cup bottom becomes a dome extending into the can body. After the dome is formed in the newly formed can body still positioned on the punch 34, the ram body 26 begins the rearward portion of the stroke from the extended position back toward the retracted position.

The can stripper 20 is disposed on the outer surface of a stripper bulkhead 60 opposite the toolpack 18. The can stripper 20 removes the can body from the punch 34 after the dome has been formed in the bottom of the can and the ram 14 has begun to move rearward. Thus, the punch 34 travels rearwardly with no cup or other material between the punch 34 and the dies 50 of the toolpack 18. In this configuration it is possible for the punch 34 to contact the dies 50 resulting in damage to the punch 34 and/or the dies 50. To prevent or reduce this damage, it is advantageous to have the longitudinal axis 28 of the ram body 26 and the die axis 54 substantially aligned. That is, the punch 34 should not be vibrating, drooping, or otherwise misaligned (e.g., due to thermal effects) with the die axis 54. The punch 34, disposed on the distal end 32 of the ram body 26 is prone to drooping as it is a cantilever body. Further, if the dome 42 of the domer die 40 is misaligned with the longitudinal axis 28 of the ram body 26, the punch 34 may be pushed out of alignment with the die axis 54 upon entering the cavity 38 of the domer die 40 and then rapidly returned, i.e. snapped, into alignment when leaving the cavity 38. This action may cause the punch 34 to vibrate. While the amount of droop, the misalignment caused by vibration, and other factors (e.g., thermal effects) are typically small, the tolerances between the punch 34 and the openings 52 of each die 50 of the toolpack 18 are sufficiently small so that any misalignment may cause contact between the punch 34 and the opening(s) 52.

Figure 2:
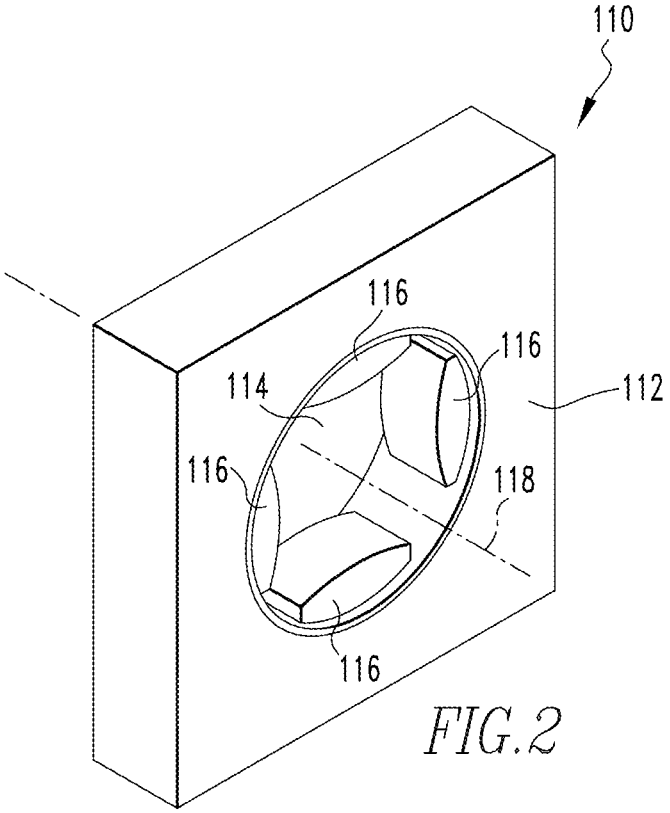
FIG. 2 is a partially schematic perspective view of a sensing arrangement in accordance with an example embodiment of the disclosed concept.
Figure 3:
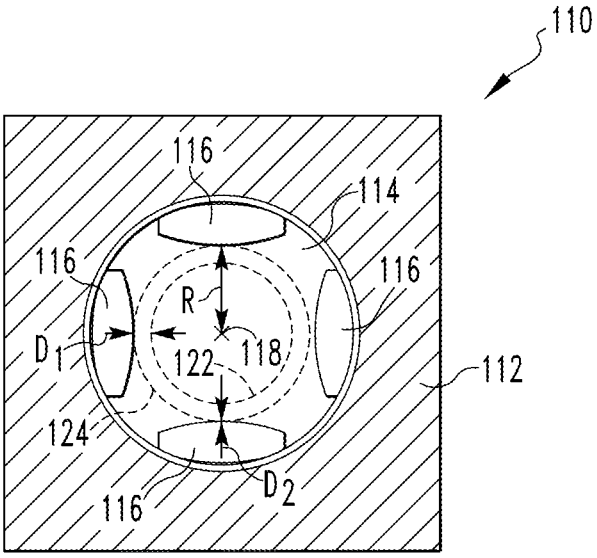
FIG. 3 is a partially schematic front elevation view of the sensing arrangement of FIG. 2.

Continuing to refer to FIG. 1, as well as to FIGS. 2 and 3, can bodymaker 10 further includes a sensing system 100 having a sensing arrangement 110 for carrying out dynamic measurements of the can body being formed on punch 34 as well as measurements of the positioning of punch 34 (and thus ram body 26) with respect to one or more components of can bodymaker 10. In the example shown in FIG. 1, the sensing arrangement 110 is positioned on or in, and coupled to stripper bulkhead 60 between toolpack 18 and can stripper 20. As discussed elsewhere herein, sensing arrangement 110 can be positioned elsewhere along the path of punch 34 (e.g., without limitation, on, in, or adjacent to, toolpack 18) without varying from the scope of the disclosed concept. The sensing arrangement 110 includes a frame 112 positioned about an opening 114 through which the punch 34/ram body 26 can freely pass. The frame 112 is structured to be secured to a desired component, such as the stripper bulkhead 60 in the example shown, or to any other desired component for a particular application. The sensing arrangement 110 further includes a plurality of sensors 116 coupled to the frame 112 about a sensing axis 118 passing through the opening 114. In the example embodiment shown in FIGS. 1-3, the sensing arrangement 110 includes four sensors 116 of generally identical construction, each spaced a distance R (FIG. 3) from the sensing axis 118 and positioned at 90° increments about the sensing axis 118. In an example embodiment, each sensor 116 is spaced a distance R from the sensing axis 118 of 0.030" more than the intended radius of a can body on the punch 34. While four sensors 116 are shown, it is to be appreciated that arrangements utilizing at least three sensors 116 may be employed without varying from the scope of the disclosed concept. Each sensor 116 stores a series of collected samples, passes the data over a determined protocol at a prescribed transfer rate, via wired or bluetooth networks while in communication with a controller 120 provided as a component of sensing system 100. Each sensor 116 is structured to provide a signal to controller 120 from which a number of characteristics of the punch 34 as well as a can body positioned on the punch 34 (as the punch 34 and can body pass through the opening 114 after passing through the toolpack 18) can be determined. Such characteristics include: the position of the punch 34 (and thus ram body 26) relative to each of the sensors 116 (and thus the frame 112, the component to which the frame 112 is coupled, etc.), the presence (or absence) of the can body, the length of the can body present on the punch 34, and the thickness of the can body (including variations thereof along the height of the can body, and/or about a circumference of the can body when multiple sensors are considered).

In an example embodiment of the disclosed concept, each respective sensor 116 is an inductive proximity sensor that is structured to provide output signals to the controller 120 proportional to the distance D1 to the surface 122 (shown in dashed line in FIG. 3) of the punch 34 from the respective sensor 116 and/or the distance D2 to the surface 124 (shown in dashed line in FIG. 3) of the can body from the respective sensor 116. In some example embodiments of the disclosed concept, the distance D1 is defined by the specifications set forth in the quality standards edict, often ranging between 0.0065" to 0.0040" and as small as 0.038"; where the distance D2, having a safety distance between the OD wall of the container/punch and the physical sensing coil representing the clearance ranging from approximately 0.080" to 0.030" depending on the container wall thickness as defined by the quality standards.

Figure 4:
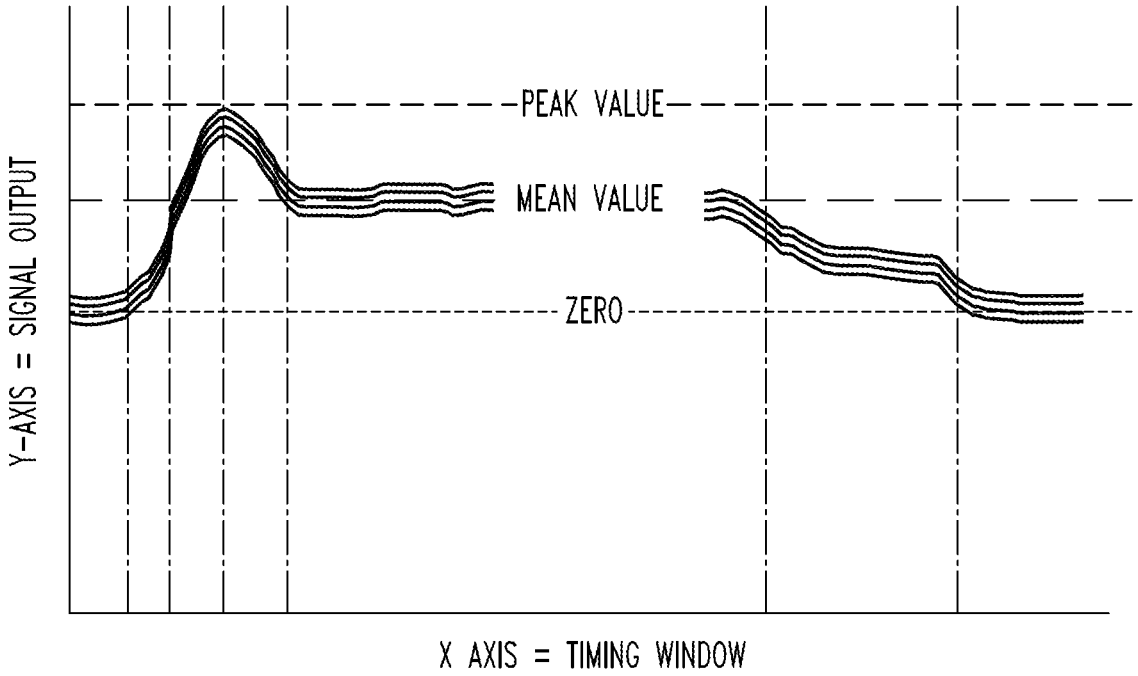
FIG. 4 is a series of graphs showing example output signals from the sensors of a sensing arrangement such as shown in FIGS. 2 and 3 when employed in a can bodymaker such as shown in FIG. 1 actively forming/producing can bodies.

FIG. 4 shows an example of a series of graphs showing example output signals as produced by the four sensors 116 of the sensing arrangement 110 (such as shown in FIGS. 2 and 3) when the sensing arrangement 110 is employed in the can bodymaker 10 such as shown in FIG. 1 while the can bodymaker 10 is actively forming/producing a can body. Each waveform in the graph represents one complete cycle or stroke as the target passes through the sensing arrangement 110. Variations in the output signal are interpreted in the algorithms of the controller 120 and provide details related to the ironing or forming of the container (i.e., the can body). Such interpretations include but are not limited to ram temperature, ram velocity, entry/exit angle, position relative to calculated center, container wall thickness and variations thereof along the body of the container. Additionally, these waveforms provide target position derived from the sensing coils known position.

The controller 120 of sensing system 100, shown schematically in FIG. 1, utilizes a programmable logic circuit (PLC) and stored algorithm(s) to analyze the signals from the sensors 116 to provide output 126. The output 126 may simply be provided to a user as a report providing details of can bodies and/or information regarding positioning of the punch 34/ram body 26 with respect to the sensing arrangement 110. Output 126 may be provided to, and utilized by other systems and or arrangements to control/adjust operation of the bodymaker 10 and/or to control/adjust positioning of one or more components of the bodymaker 10 as discussed below. Although shown as a stand-alone component, it is to be appreciated that the controller 120 may be a control device employed for other operations related to the bodymaker 10.

FIGS. 5-15 show some example arrangements of ram assemblies and related components in accordance with example embodiments of the disclosed concept that may be utilized in conjunction with sensing arrangements and/or systems such as previously described to provide for the selective adjustment of the positioning of a ram body/punch positioned thereon during normal operation of the bodymaker utilizing feedback from such sensing arrangements/systems.

Figure 5:
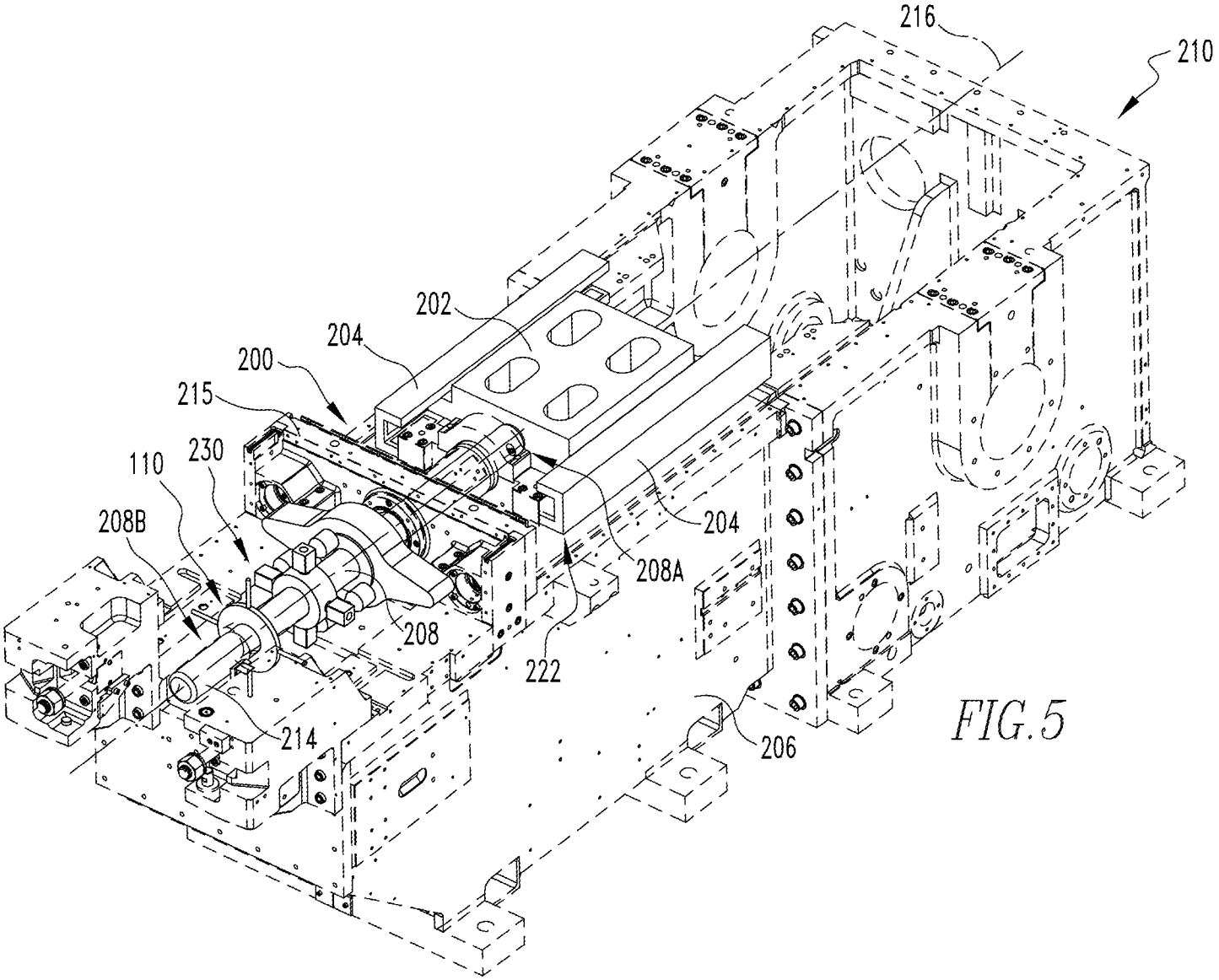
FIG. 5 is a perspective view of a portion of a can bodymaker having a ram assembly in accordance with one example embodiment of the disclosed concept.
Figure 6:
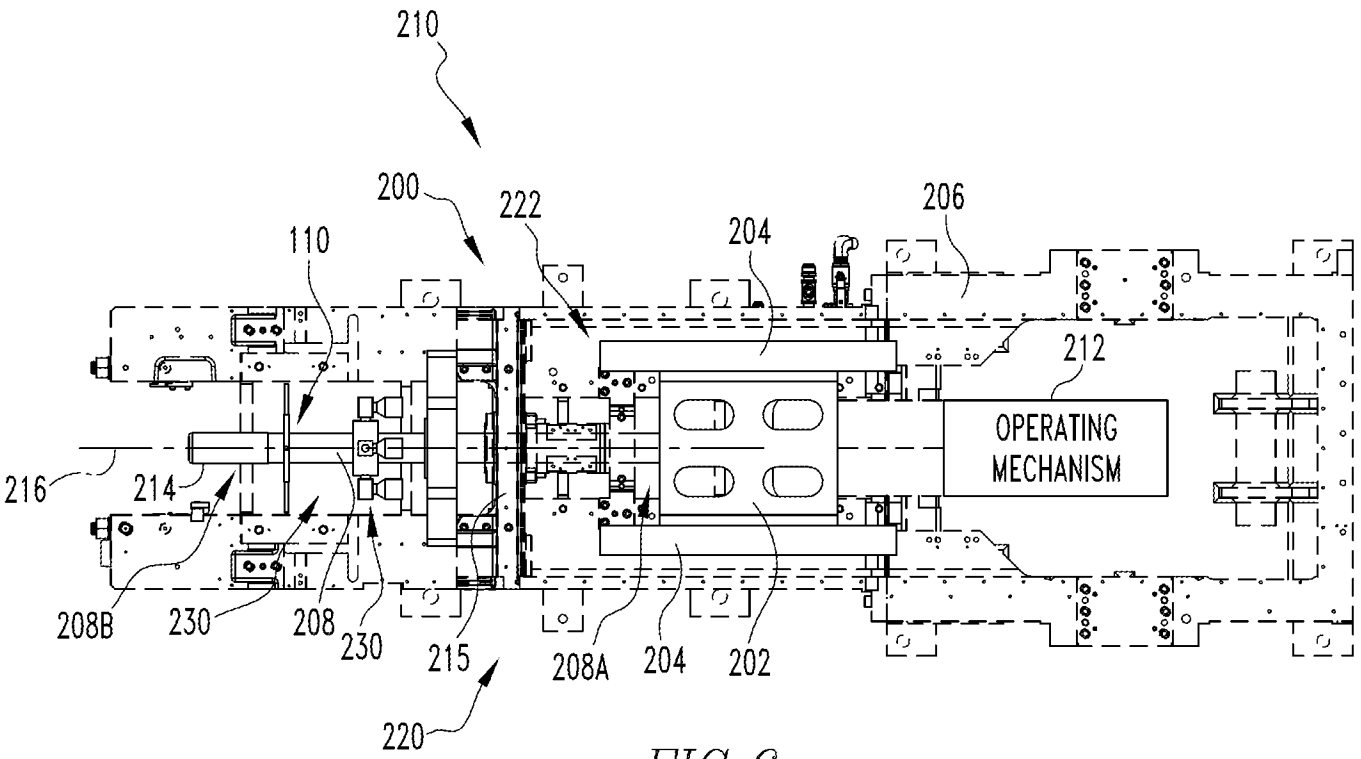
FIG. 6 is a partially schematic top view of the portion of the can bodymaker of FIG. 5.
Figure 7:
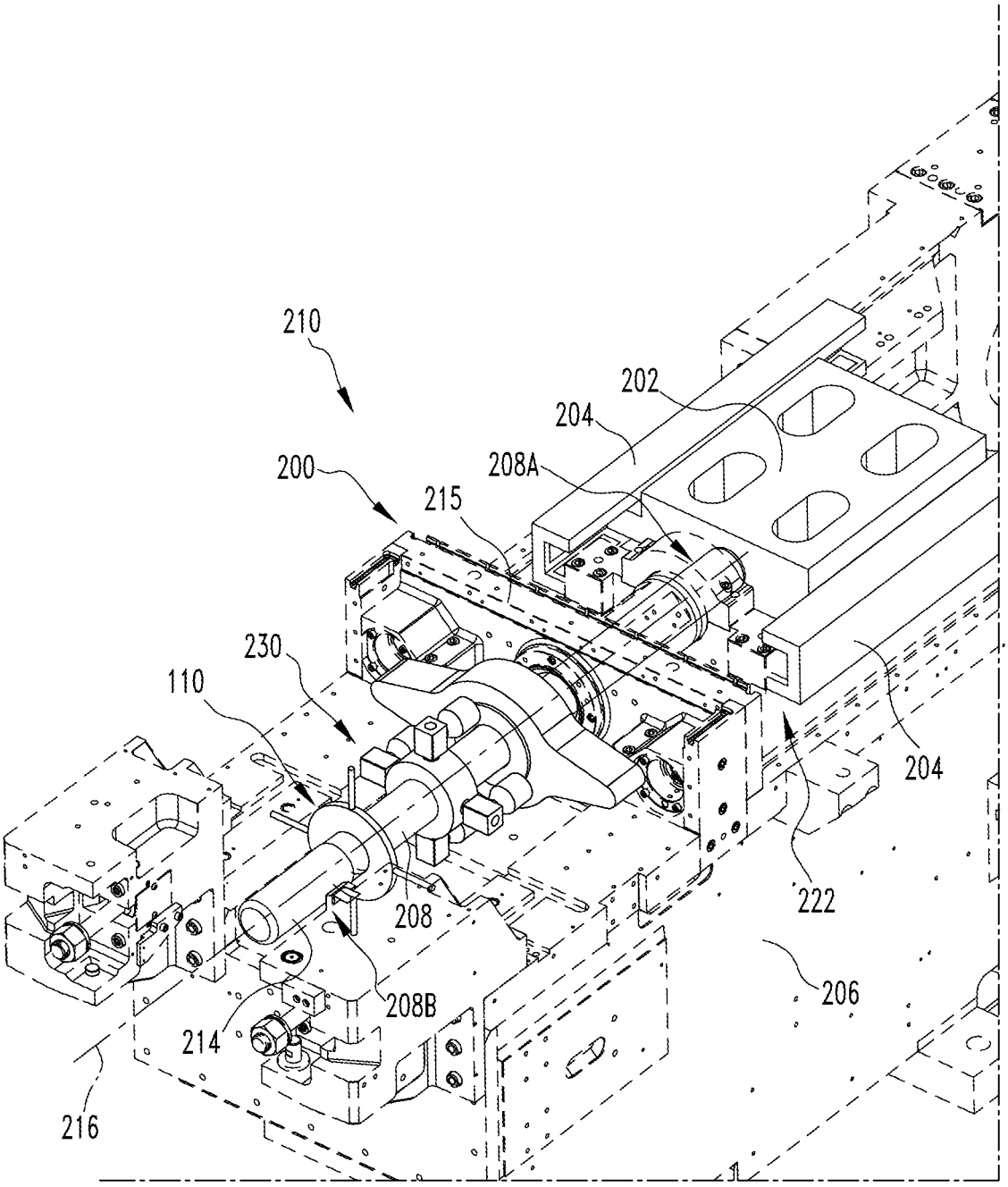
FIG. 7 is a perspective view of a portion of the of the portion of the can bodymaker of FIGS. 5 and 6.

Referring first to FIGS. 5-7, an example ram assembly 200 in accordance with one example embodiment of the disclosed concept is shown positioned in a portion of a can bodymaker 210 (e.g., of similar construction as can bodymaker 10 previously described). Ram assembly 200 includes a carriage 202 (e.g., formed from aluminum or other suitable material or materials) slidingly engaged within a pair of slideways 204 (each labeled 204) that are each rigidly coupled to a frame 206 of the can bodymaker 210. Carriage 202 is positioned within can bodymaker 210 and is operatively coupled to a suitable operating mechanism 212 (shown schematically in FIG. 6, similar to operating mechanism 12 previously discussed) that is structured to translate carriage back and forth in a reciprocating manner similar to carriage members commonly known in the art. Ram assembly 200 further includes an elongated ram body 208 of generally cylindrical shape extending between a first end 208A and an opposite second end 208B thereof. The first end 208A of ram body 208 is coupled to carriage 202, while the second end 208B of ram body 208 includes a punch 214 positioned thereon. Punch 214 may be coupled to ram body 208 or formed as a portion of ram body 208. Ram body 208 is supported (e.g., via a suitable seal and/or bearing arrangement) at a location (not numbered) between first and second ends 208A and 208B by a primary bulkhead 215 that is rigidly coupled to frame 206 of can bodymaker 210. The location between first and second ends 208A and 208B at which ram body 208 is supported by primary bulkhead 215 varies due to the reciprocating movement of ram body 208 with respect to frame 206 of can bodymaker 210. Accordingly, carriage 202 (and thus ram body 208 via carriage 202) is operatively coupled to operating mechanism 212 of can bodymaker 210. In operation, operating mechanism 212 causes carriage 202 (and thus ram body 208 and punch 214) to translate back and forth (with ram body supported by primary bulkhead 215) generally along a primary axis 216 (FIG. 5) during normal can forming operation of can bodymaker 210 (such as generally described above in conjunction with FIGS. 1-4).

Figure 8:
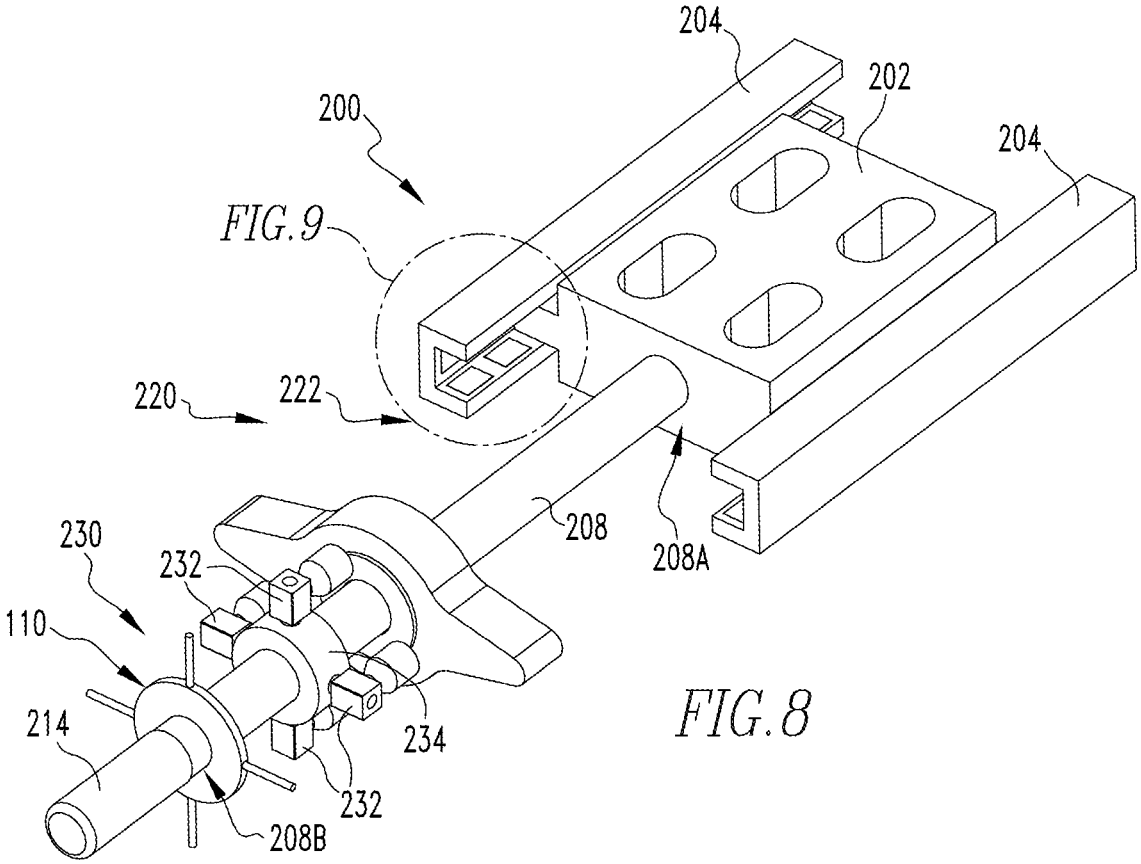
FIG. 8 is a perspective view of the ram assembly of FIGS. 5-7.
Figure 9:
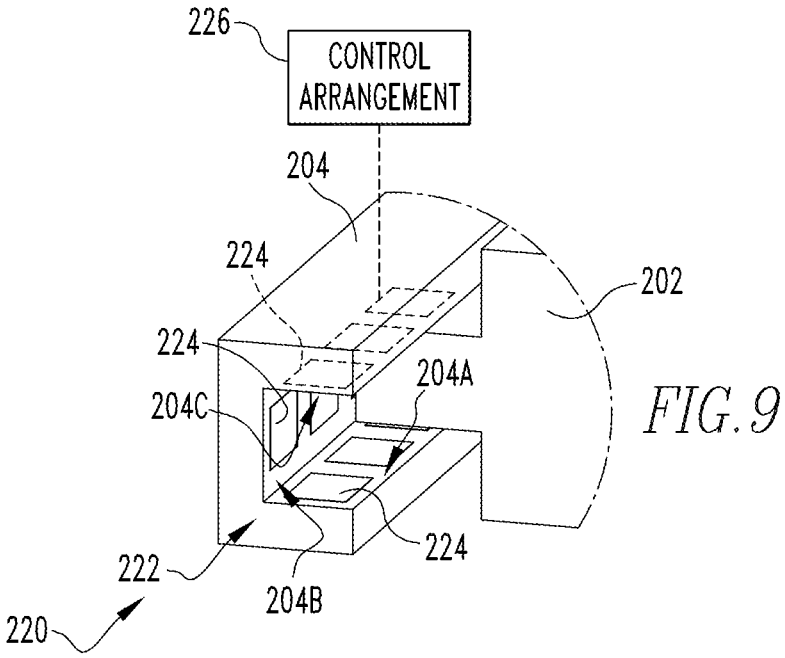
FIG. 9 is a detail view of a portion of the ram assembly of FIG. 8 as indicated in FIG. 8.

Continuing to refer to FIGS. 5-7, and additionally to FIGS. 8 and 9, ram assembly 200 further includes an adjustment arrangement 220 structured to provide for dynamic adjustment of the radial positioning of punch 214 (as well as portions of ram body 208) with respect to the primary axis 216 as ram body 208 moves through primary bulkhead 215 and punch 214 moves generally along primary axis 216 during normal can forming operations of can bodymaker 210. The adjustment arrangement 220 can be of different types. For example, the embodiment shown in FIGS. 5-9 includes an electromagnetic adjustment arrangement 222 that includes a number of electromagnetic bearings 224 (shown schematically) positioned in and/or on each of slideways 204 facing carriage 202 for interacting with carriage 202. More particularly, as shown in the detail view of FIG. 9, in such example embodiment each slideway 204 is a c-shaped member having three inward facing surfaces 204A, 204B, and 204C, with electromagnetic bearings 224 positioned in and/or on each of inward facing surfaces 204A, 204B, and 204C. Each electromagnetic bearing 224 is coupled to a suitable control arrangement 226 (such as controller 120 previously discussed with regard to FIG. 1) that is structured to selectively vary the electromagnetic force of one or more of electromagnetic bearings 224 as desired thus providing for the positioning of carriage 202 with respect to slideways 204 (and thus to frame 206 and components of bodymaker 210 coupled directly or indirectly thereto) to be selectively varied. Such arrangement of the electromagnetic bearings 224 thus allows for selective adjustment of the path/striking position of the moving punch 214 during normal operation of the bodymaker by adjusting the positioning of carriage 202 as it moves along slideways 204 using ram body 208 and primary bulkhead 215 as a lever/fulcrum arrangement. For example: moving carriage 202, and thus first end 208A of ram body 208, downward moves second end 208B of ram body 208 and thus punch 214 upward, moving carriage 202 to one side moves punch 214 to the opposite side, etc. As an alternative to such adjustment arrangements in which the adjustment are made via the interaction between a carriage and corresponding slideways, such adjustment may instead be carried out by adjusting the interaction/positioning of the slideways with respect to the frame of the bodymaker. In another example embodiment in accordance with the disclosed concept, the geometry/relationship of the slideways 204 and moving carriage 202 are reversed, such that the opposing outer edges (not numbered) of the carriage 202 are generally c-shaped while each slideway 204 is a rail-like element positioned in the groove formed by each c-shaped side of the carriage 202. In such arrangement the number of electromagnetic bearings 224 are positioned in and/or on each of slideways 204 facing the carriage 202 for interacting with carriage 202, however, due to the reversed geometry the electromagnetic bearings 224 face outward from each slideway 204 toward the inward facing surfaces of the c-shaped sides of the carriage 202.

Figure 13:
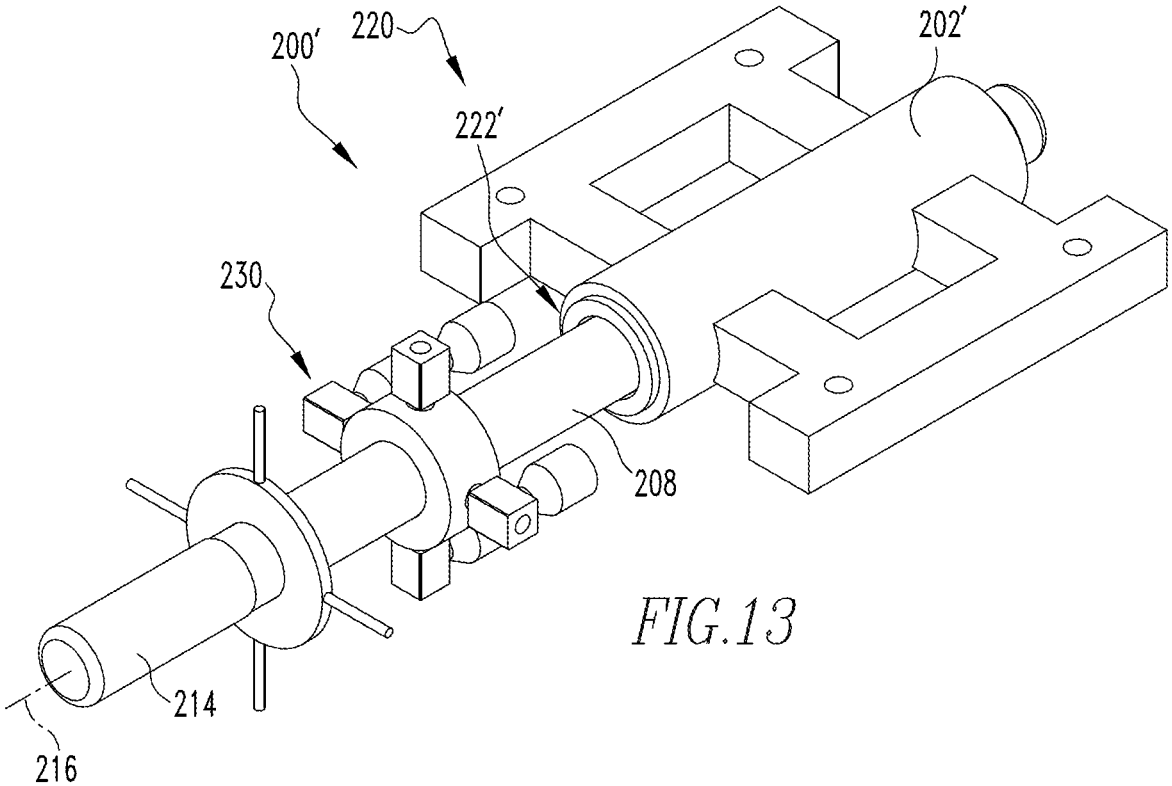
FIG. 13 is a perspective view of a portion of a ram assembly in accordance with another example embodiment of the disclosed concept.

FIGS. 13-15 show a ram assembly 200' in accordance another example embodiment of the disclosed concept that also utilizes an electromagnet adjustment arrangement 222'. Similar to ram assembly 200, ram assembly 200' includes a carriage 202' movable back and forth via an operating mechanism (such as operating mechanism 212 or any other suitable arrangement) as well as an elongated ram body 208 of generally cylindrical shape having a first end 208A and an opposite second end 208B. The first end 208A of ram body 208 is supported/carried by the carriage 202', while the second end 208B of ram body 208 includes a punch 214 positioned thereon. Unlike the electromagnetic adjustment arrangement 222 of ram assembly 200 that utilizes electromagnetic bearings 224 to selectively control/vary the positioning of carriage 202 (and thus ram body 208 and punch 214) with respect to slideways 204, the electromagnetic adjustment arrangement 222' of ram assembly 200' includes/utilizes electromagnetic bearings 224' positioned facing the ram body 208 in and/or on a surface of a cylindrical aperture 226 defined in/by carriage 202'. Each electromagnetic bearing 224' is coupled to a suitable control arrangement 226' (such as controller 120 previously discussed or any other suitable arrangement) that is structured to selectively vary the electromagnetic force of one or more of electromagnetic bearings 224' thus providing for the positioning of first end 208A of ram body 208 with respect to carriage 202' to be selectively varied and thus the positioning of second end 208B of ram body 208 and punch 214 coupled thereto to be varied similar to the adjustment arrangement 222 of FIGS. 5-9.

Figure 10:
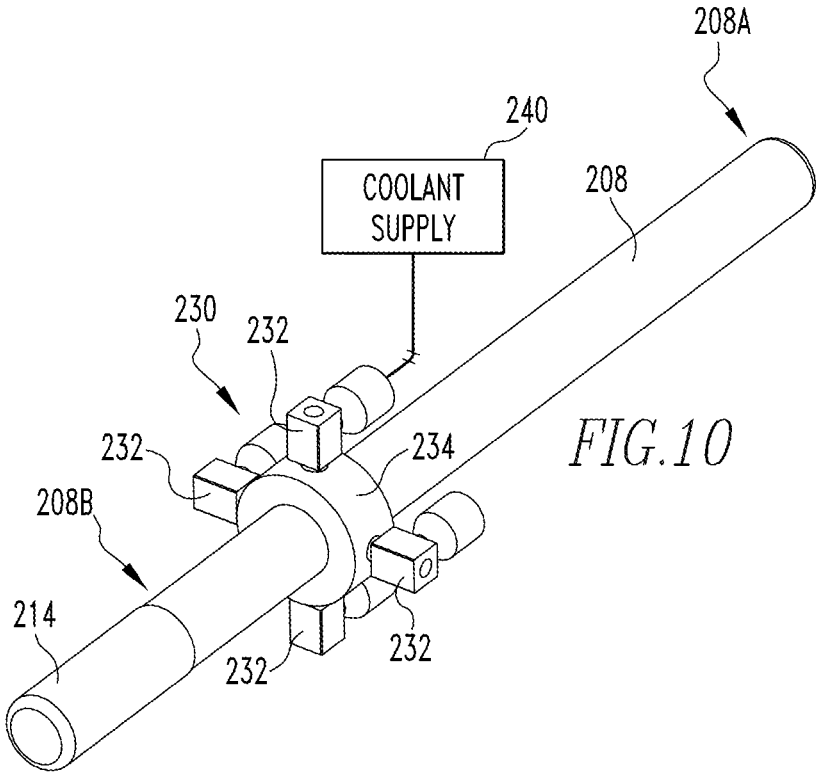
FIG. 10 is a perspective view of a portion of the ram assembly of FIGS. 5-8.
Figure 11:
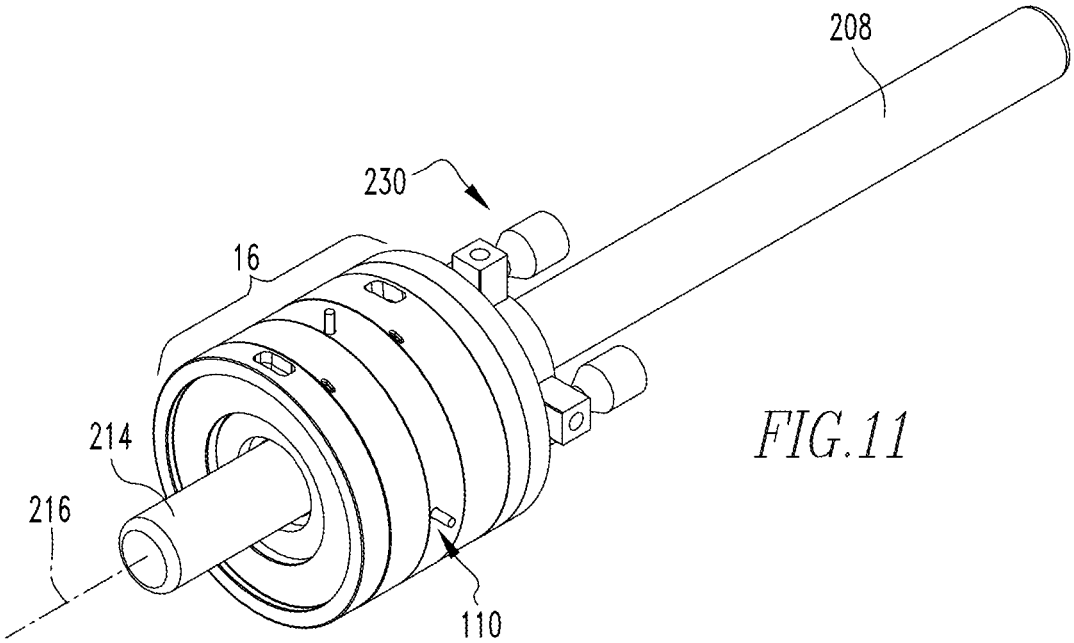
FIG. 11 is a perspective view of the portion of the ram assembly shown in FIG. 10 shown with an example toolpack positioned therewith in accordance with one example embodiment of the disclosed concept.
Figure 12:
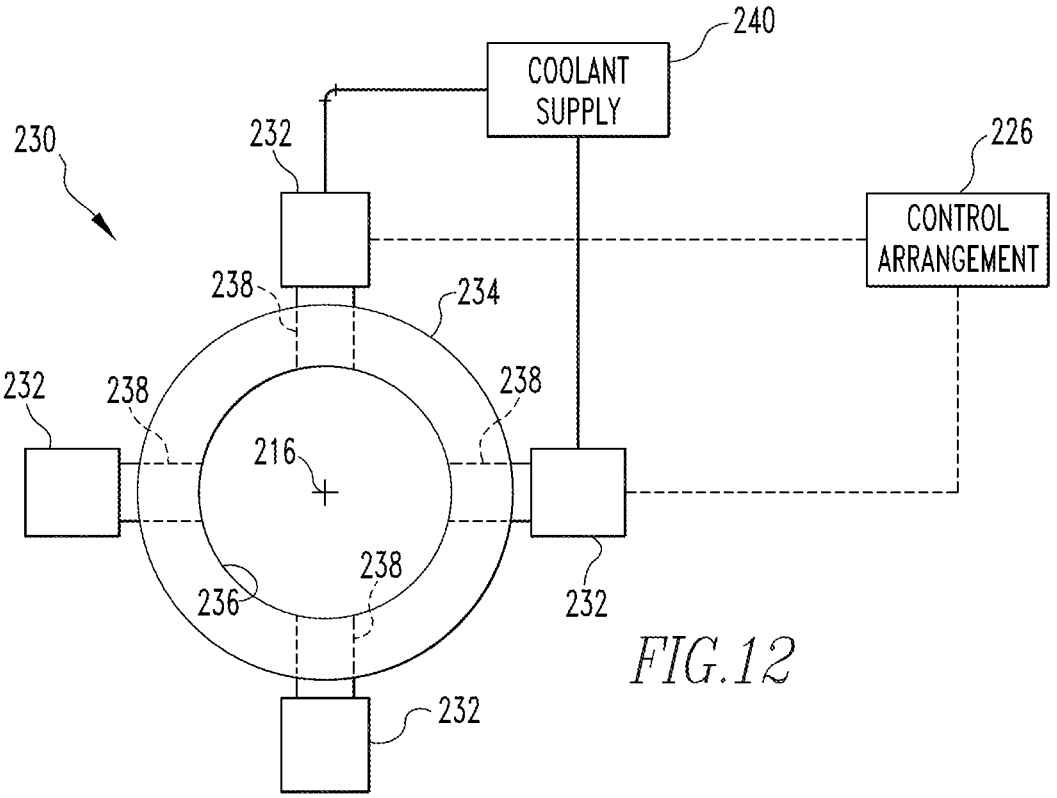
FIG. 12 is an elevation view of a thermodynamic adjustment arrangement in accordance with an example embodiment of the disclosed concept.

As an alternative, or in addition, to an electromagnetic adjustment arrangement 222, 222' such as the examples previously discussed (or another suitable arrangement), adjustment arrangement 220 may be a thermodynamic adjustment arrangement 230 that provides for the selective manipulation of the temperature distribution at some number of points (currently shown as 4) around the ram body 208 to induce a controlled warping of ram body 208 (e.g., similar to how a bi-metallic strip works) to selectively control positioning of second end 208B of ram body 208 and thus of punch 214 as well as to potentially correct undesired straightness error of the ram (e.g., due to sag or other effects). Referring to FIGS. 10-12, thermodynamic adjustment arrangement 230 includes a plurality of thermal control valves 232, each in communication with a suitable coolant supply 240 (FIG. 12) and structured to control a flow of such coolant therethrough. The plurality of thermal control valves 232 are positioned in and by a mounting ring 234 about ram body 208. More particularly, mounting ring 234 includes a central opening 236 and a plurality of secondary apertures 238 (shown in hidden line in FIG. 12) defined in the mounting ring 234 extending generally perpendicular (i.e., radially) to the central opening 236. Central opening 236 is sized so as to allow the ram body 208 to pass therethrough without contact between ring 234 and ram body 208 while allowing for coolant provided by coolant supply 240 via one or more of thermal control valves 232 to flow through the annular space between ring 234 and ram body 208. Each secondary aperture 238 of the plurality houses an outlet (not numbered) of a respective thermal control valve 232 of the plurality of thermal control valves 232. In the example shown in FIGS. 10-12, four thermal control valves 232, oriented radially, and spaced every 90 degrees about the central opening 236 through which the ram body 208 passes are utilized. It is to be appreciated, however, that one or more of the quantity, spacing and/or positioning/orientation of control valves 232 (and related components) may be varied to fit the particular needs of a specific application without varying from the scope of the disclosed concept. Each thermal control valve 232 is structured such that upon activation (i.e., opening) of a particular thermal control valve(s) 232 coolant from coolant supply 240 is provided to the corresponding portion(s) (i.e., in the example of FIGS. 10-12 quadrant(s)) of ram body 208 thus selectively cooling such portion(s). As a result of such selective cooling, ram body 208 is caused to selectively bend in a predictable manner, thus providing for the positioning of punch 214 to be selectively adjusted and/or unwanted curvature of ram body 208 to be corrected.

The positioning of thermodynamic adjustment arrangement 230 along axis 216 generally depends on the required sensitivity of the ram striking position to thermal deformation. For example, placing the arrangement 230 further from a toolpack 218 (FIG. 11) will result in larger striking position deviations for the same induced thermal stress on ram body 208 due to a larger cantilever (i.e., the length of ram body 208 present between arrangement 230 and toolpack 218). Accordingly, placement of the arrangement 230 relative to the toolpack 218 can be used as a "sensitivity control" feature, subject to the stroke of the bodymaker and the overall length of the ram body.

From the foregoing examples it is to be appreciated that by utilizing feedback from a sensing arrangement such as sensing arrangement 110 to determine/make adjustments via adjustment arrangement 220 in a closed loop feedback arrangement embodiments of the disclosed concept provide for dynamic adjustments to be made during normal body-making operations of the can bodymaker without stopping the bodymaker.

As an alternative, or in addition, to adjusting the positioning of a ram body/punch itself such as previously described, the position of other components within a can bodymaker can be adjusted to ensure optimum alignment between the ram body/punch and the toolpack and/or particular forming dies of the toolpack. An example of such an arrangement in accordance with the present invention is shown schematically in FIG. 16 which presents a can bodymaker 10' similar to can bodymaker 10 shown in FIG. 1 and previously discussed. Can bodymaker 10' differs from can bodymaker 10 in that can bodymaker 10' includes a sensing system 100' having a sensing arrangement 110' (similar to sensing arrangement 110 or any other suitable sensing arrangement) that is secured/coupled to toolpack 18. In the particular example shown in FIG. 16, sensing arrangement 110' is shown coupled adjacent third die 50C (i.e., the last/end die though which the cup/formed can passes before exiting toolpack 18, and more particularly on the inward side of third die 50C. However, it is to be appreciated that sensing arrangement 110' may be coupled/secured to toolpack 18 on the opposite side of third die 50C or at any other location on or within toolpack 18 without varying form the scope of the disclosed concept. Further, sensing arrangement 110' may be positioned adjacent/near toolpack (e.g., without being directly coupled thereto), without varying from the scope of the disclosed concept. It is also to be appreciated that more than one sensing arrangement 110' (and/or 110) may be employed on or within toolpack 18 and/or outside of toolpack 18 (e.g., without limitation, such as shown in FIG. 1) without varying from the scope of the disclosed concept. Like sensing arrangement 100, sensing arrangement 100' includes a controller (e.g., without limitation, the same or similar to controller 120 previously described) in communication with sensing arrangement 110' (and/or other sensing arrangement(s)).

Figure 16:
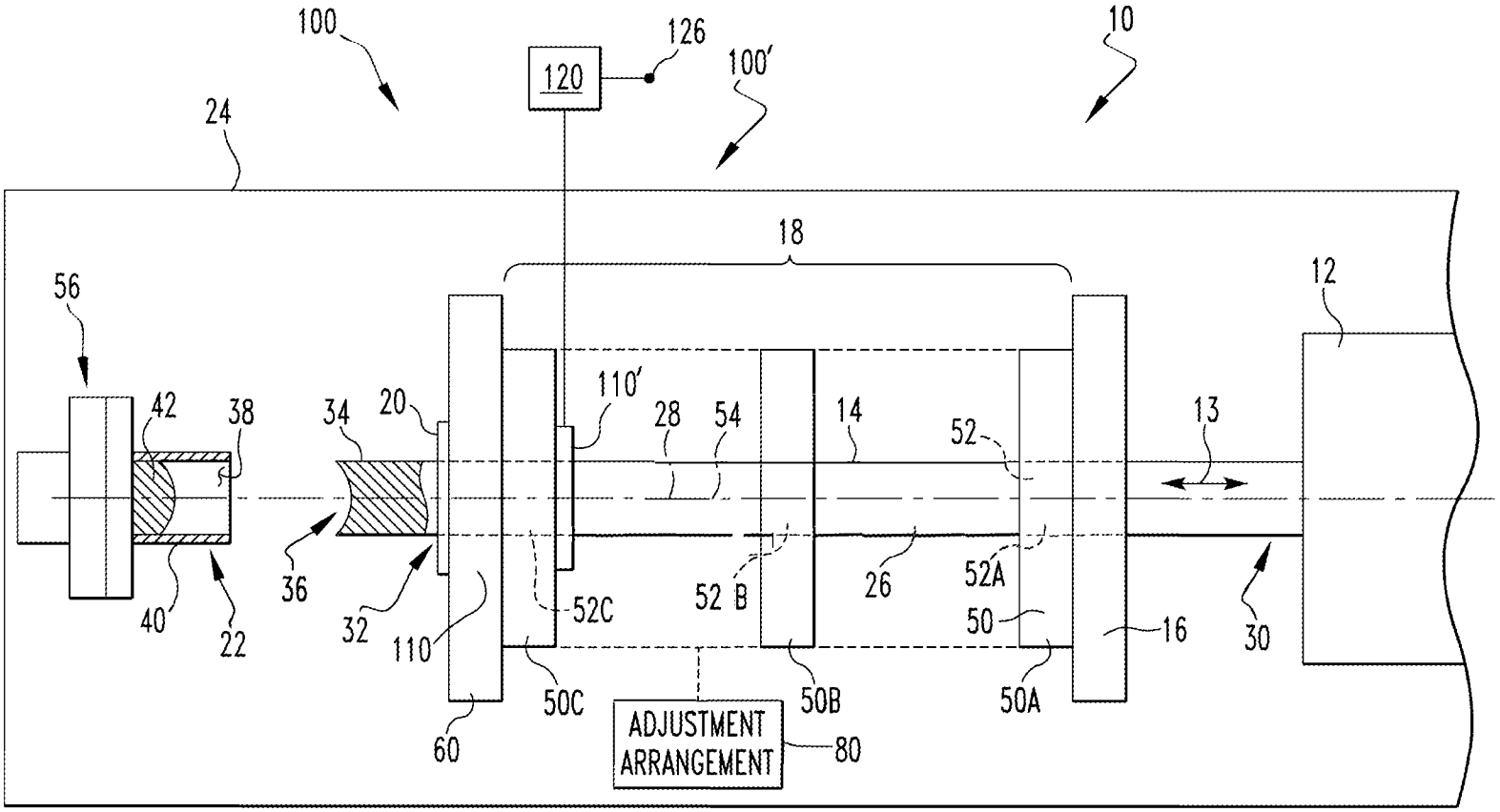
FIG. 16 is a schematic sectional view of a can bodymaker similar to FIG. 1 in accordance with another example embodiment of the disclosed concept.
Figure 17:
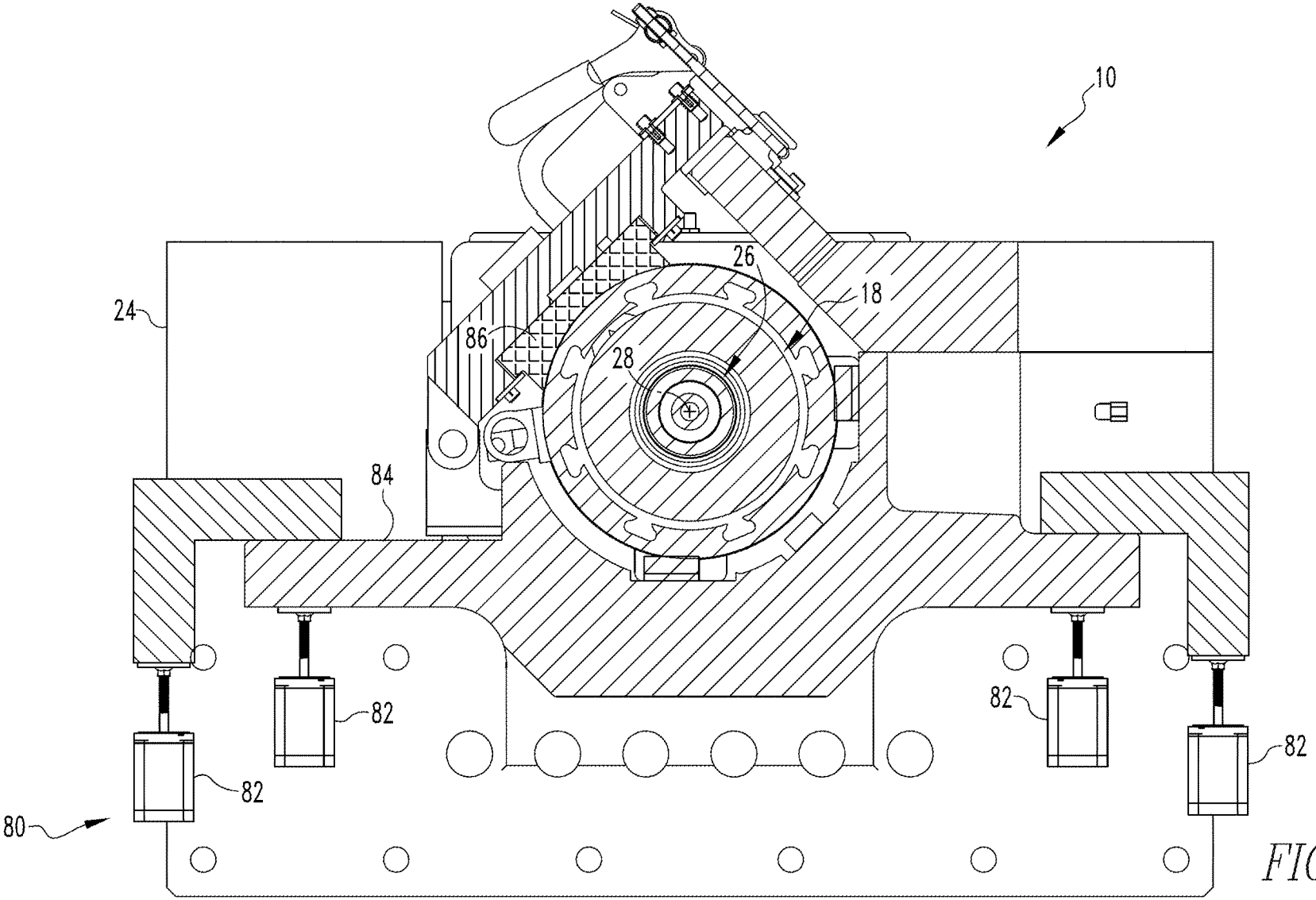
FIG. 17 is a simplified sectional view of a portion of a can bodymaker showing an adjustment arrangement for adjusting the positioning of the toolpack of the can bodymaker in accordance with an example embodiment of the disclosed concept.
Figure 18:
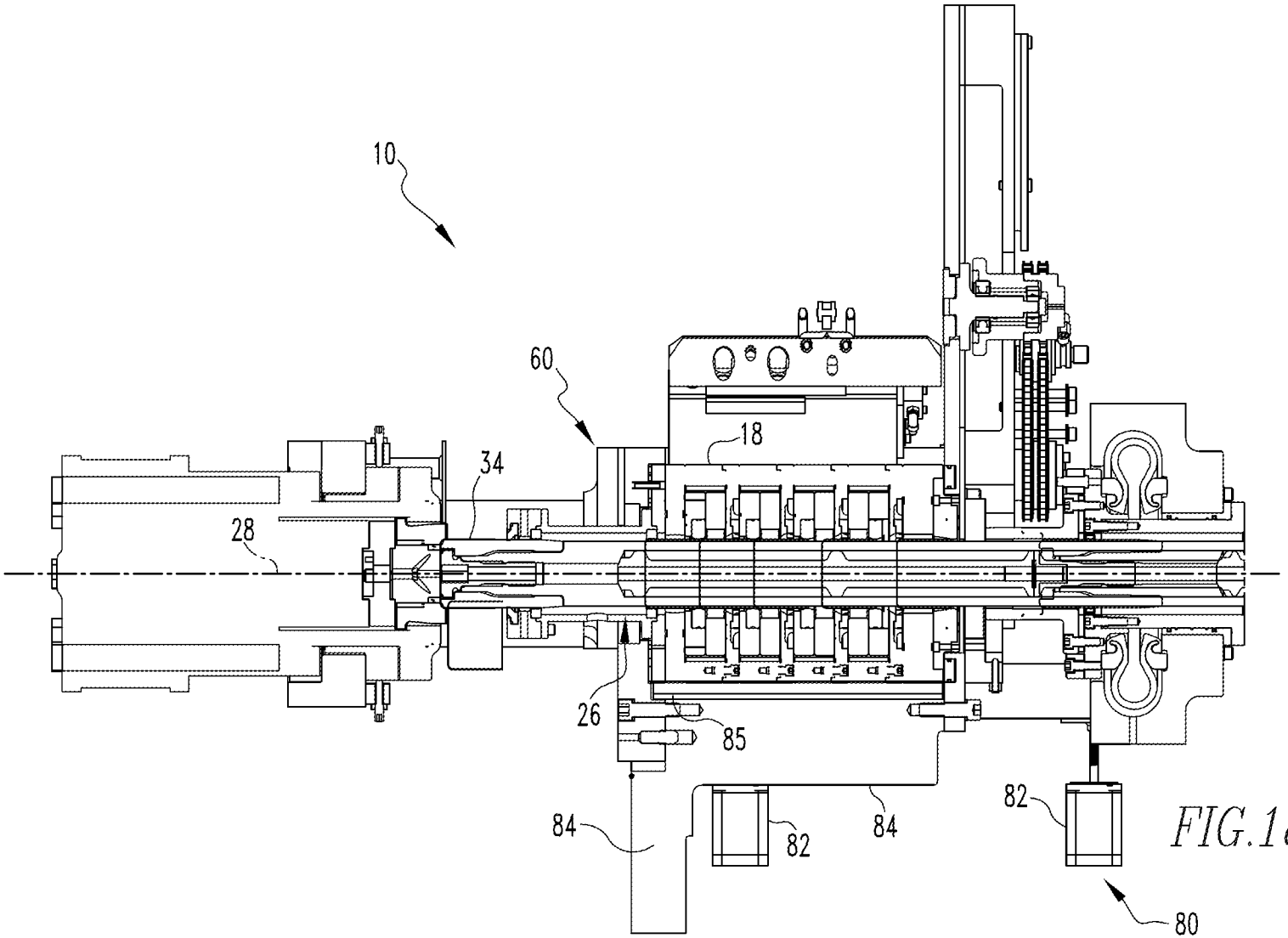
FIG. 18 is a simplified sectional view of a portion of a can bodymaker showing an adjustment arrangement for adjusting the positioning of the toolpack of the can bodymaker in accordance with another example embodiment of the disclosed concept.
Figure 19:
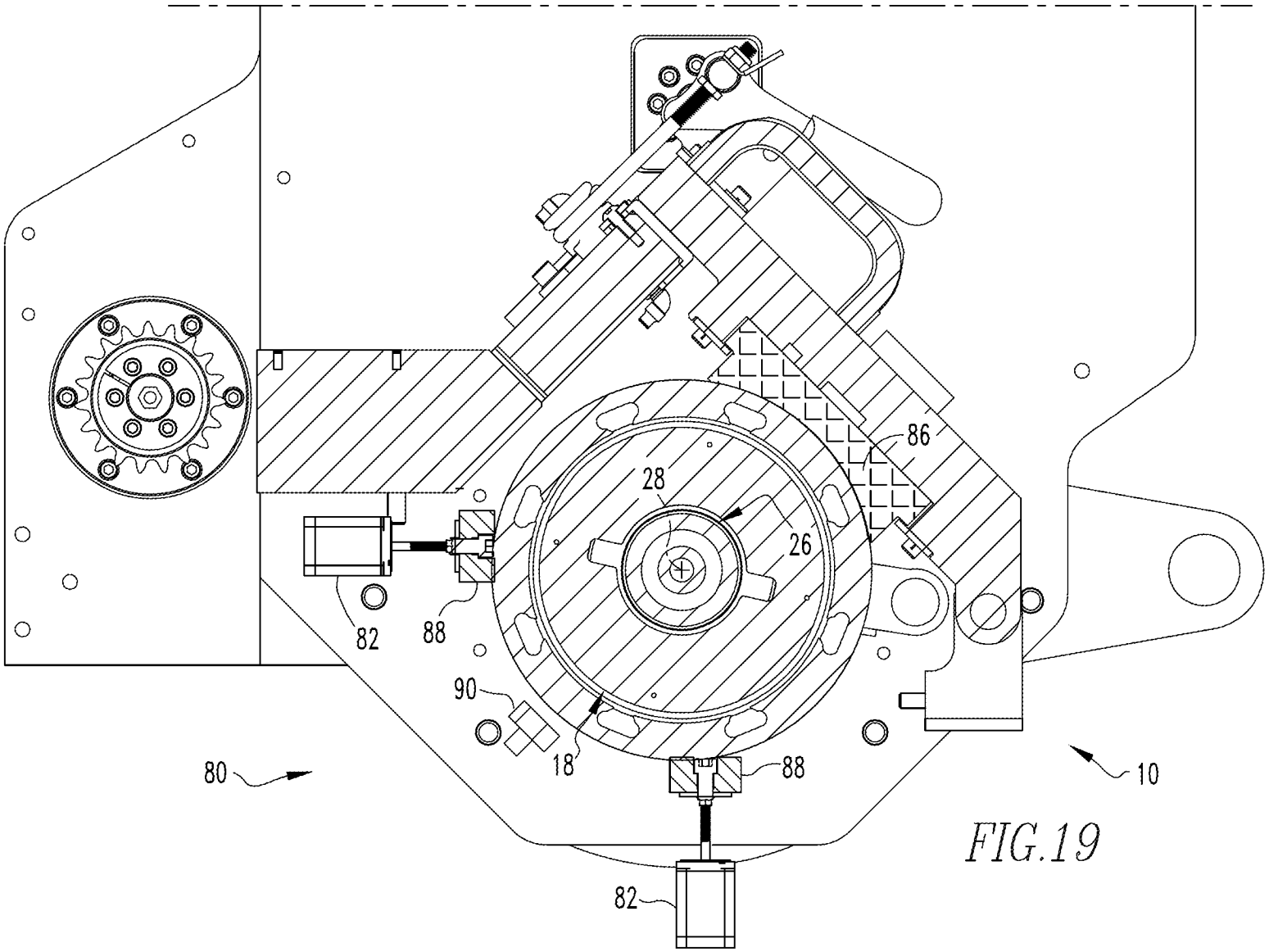
FIG. 19 is a simplified sectional view of a portion of a can bodymaker showing an adjustment arrangement for adjusting the positioning of the toolpack of the can bodymaker in accordance with yet another example embodiment of the disclosed concept.
Figure 20:
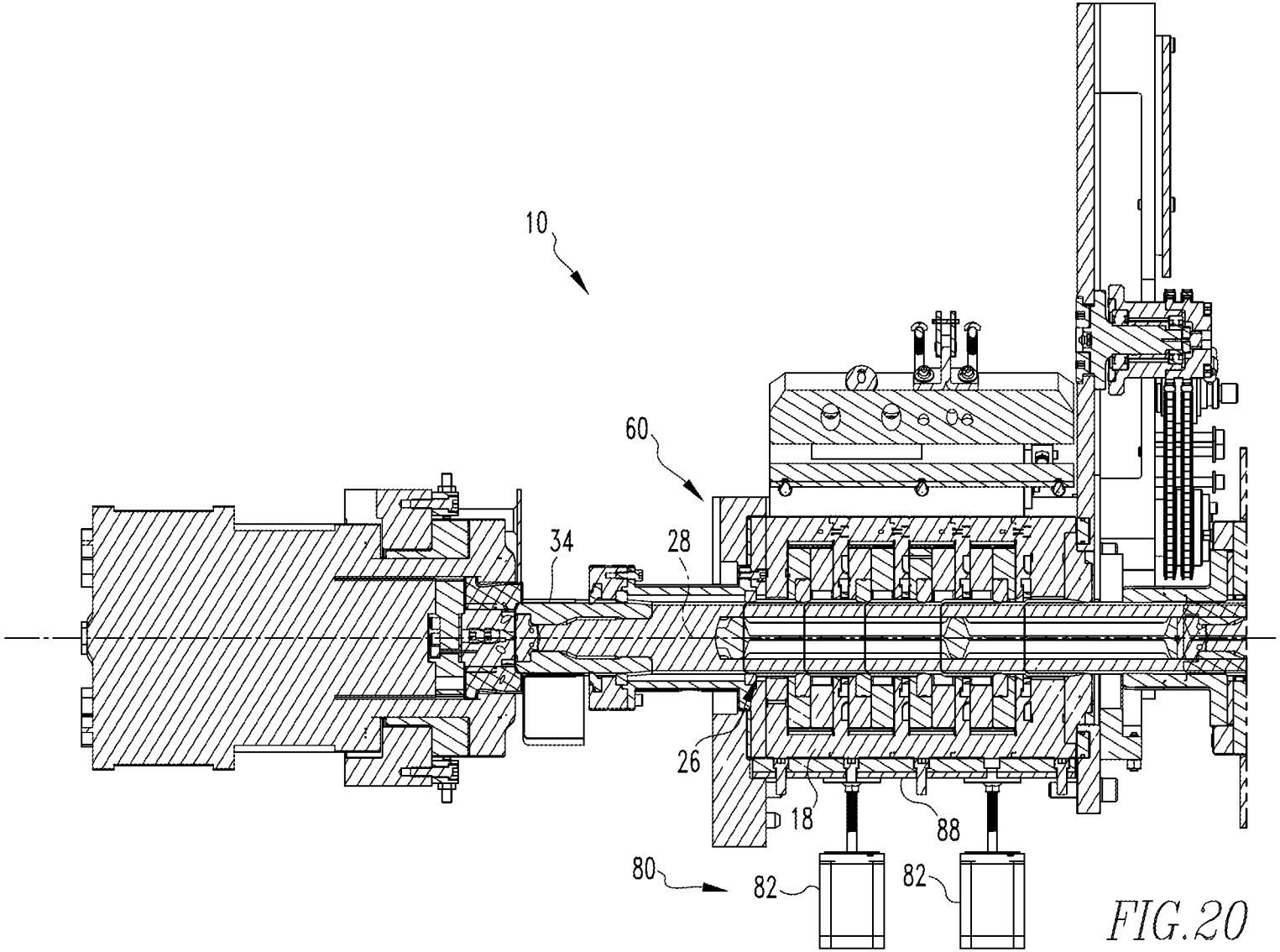
FIG. 20 is a simplified sectional view of a portion of a can bodymaker showing an adjustment arrangement for adjusting the positioning of the toolpack of the can bodymaker in accordance with a further example embodiment of the disclosed concept.

Continuing to refer to FIG. 16, sensing system 100' further includes an adjustment arrangement 80 in communication with/controlled by controller 120. Adjustment arrangement 80 is coupled to the toolpack 18 to selectively adjust (e.g., vertically, horizontally, or a combination thereof, at the direction of controller 120) the position of toolpack 18 (based on the feedback from sensing arrangement 110') relative to the frame 24 and/or the ram 14 (or components/portions there), and thus the opening 52 of dies 50 of the toolpack 18 relative to ram 14/punch 34 as it/they pass therethrough during normal can body making operations of bodymaker 10'. Adjustment arrangement 80 may be mechanically, pneumatically, or hydraulically driven (or via any other suitable arrangement) to physically adjust toolpack 18 directly, or indirectly via one or more elements (not numbered) supporting toolpack 18. It is to be appreciated that adjustment arrangement 80 may include any suitable number of (i.e., one or more than one) mechanisms that adjust the entirely of toolpack 18 or individual dies 50 thereof without varying form the scope of the disclosed concept. It is thus to be appreciated that the arrangement shown in FIG. 16 provides for an adjustment arrangement that dynamically adjusts the positioning of toolpack 18 (and/or individual dies 50 thereof) via a controlled feedback loop including controller 120 and sensing arrangement 110' (and other sensing arrangements depending on the application), to align toolpack 18 to ram 14/punch 34 as the pitch of ram 14 varies as a biproduct of speed during normal can body making operations of bodymaker 10'.

FIGS. 17-20 show some views of non-limiting example embodiments of adjustment arrangements 80 employed with bodymakers 10 in accordance with some example embodiments of the disclosed concept. In each of such examples, the adjustment arrangement 80 includes a number, and more particularly a plurality, of adjustment mechanisms 82 that are in communication with/controlled by a controller, such as controller 120 shown in the example arrangement of FIG. 16. Each adjustment mechanism 82 may be a suitable arrangement that is driven mechanically, pneumatically, hydraulically, electrically or via any other suitable arrangement to physically adjust the toolpack cradle 84 (FIG. 17, which houses the toolpack 18), or to directly adjust the toolpack 18 itself, relative to the frame 24 and/or the ram 14 (or components thereof) by moving the rails 85 (FIG. 18) on which the toolpack 18 is positioned. Some non-limiting examples of suitable arrangements which may be used as one or more of adjustment mechanisms 82 include, without limitation, a motor connected to a shaft with threads which directs the adjustment motion of the toolpack parallel to the axis of the threads, and a piston/cylinder arrangement where a fluid is compressed to drive the motion of the piston.

The adjustment mechanisms 82 may be positioned in several different ways depending on the desired adjustability to the positioning of the toolpack 18. In each case, each adjustment mechanism is typically coupled between the frame 24 (or an element or combination thereof connected to the frame 24) of the bodymaker 10 and the toolpack 18 (directly or via one or more elements coupled therebetween). As an example, the arrangement shown in FIG. 17 utilizes four adjustment mechanisms 82 that are each (directly) engaged with a cradle 84 that supports the toolpack 18 and generally biases the toolpack 18 against a suitable flexible material 86. In the example arrangement shown in FIG. 18, two adjustment mechanisms 82 are utilized to adjust support rails 85 of the toolpack 18. The example shown in FIG. 19 utilizes a flexible material 86 similar to the example shown in FIG. 17, but uses two adjustment mechanisms 82 positioned generally 90° with respect to each other and in more direct engagement (e.g., via wear plates 88) with tool pack 18 (which is also shown potentially constrained via another wear plate 90). Meanwhile, the example shown in FIG. 20 uses two adjustment mechanisms 82 spaced along the bottom of the toolpack 18 and engaged therewith generally via the wear plate 88. It is to be appreciated that such arrangements, combinations of all or portions thereof, or other variations thereof may be employed to provide for dynamic adjustment of the positioning of toolpack 18 (generally in any direction and/or angle) with respect to the path of ram body 26/punch 34 to optimize such positioning of the toolpack 18 as needed during operation of the bodymaker 10 during normal can body making operations (or generally during any point of time during or outside of operation thereof).

From the foregoing it is thus to be appreciated that the disclosed concept provides for can bodymakers that can dynamically adjust positioning of components therein to maintain proper alignment among components therein while carrying out normal can bodymaking operations. Such bodymakers can be operated more autonomously than conventional arrangements and require less down time.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A toolpack arrangement for a can bodymaker having a frame, the toolpack arrangement comprising:

a toolpack having a number of forming dies; and an adjustment arrangement comprising a number of adjustment mechanisms structured to be coupled between the toolpack and the frame, each adjustment mechanism being structured to dynamically selectively adjust the positioning of the toolpack with regard to the frame and/or a ram body of the can bodymaker as the ram body passes within the toolpack during normal can body making operations of the can bodymaker.

2. The toolpack arrangement of claim 1, wherein the adjustment arrangement further comprises a controller in communication with each adjustment mechanism of the number of adjustment mechanisms, wherein the controller is structured to selectively control each adjustment carried out by the number of adjustment mechanisms.

3. The toolpack arrangement of claim 2, further comprising a sensing arrangement in communication with the controller, wherein the sensing arrangement includes a number of sensors structured to detect the position of a number of components of the bodymaker, and wherein the controller is structured to selectively control each adjustment of the adjustment arrangements based at least in part from input received from the number of sensors.

4. The toolpack arrangement of claim 1, wherein the number of adjustment mechanisms comprises a plurality of adjustment mechanisms.

5. The toolpack arrangement of claim 1, further comprising a cradle supporting the toolpack, wherein the number of adjustment mechanisms are coupled to the toolpack via the cradle.

6. The toolpack arrangement of claim 1, wherein the number of adjustment mechanisms are driven by one or more of a mechanical, pneumatic, electrical and/or a hydraulic means.

7. The toolpack arrangement of claim 4, wherein each adjustment mechanism of the plurality of adjustment mechanisms are driven by one or more of a mechanical, pneumatic, electrical and/or a hydraulic means.

8. A can bodymaker for forming a plurality of can bodies, the can bodymaker comprising:

a frame;

a ram;

an operating mechanism structured to provide a reciprocating motion to the ram; and a toolpack arrangement comprising:

a toolpack having a number of forming dies positioned such that the ram passes therewithin when provided with the reciprocating motion by the operating mechanism; and an adjustment arrangement comprising a number of adjustment mechanisms coupled between the toolpack and the frame, each adjustment mechanism being dynamically adjustable so as to selectively adjust the positioning of the toolpack with regard to the frame and/or the ram as the ram passes within the toolpack during normal can body making operations of the can bodymaker.

9. The can bodymaker of claim 8, wherein the adjustment arrangement further comprises a controller in communication with each adjustment mechanism of the number of adjustment mechanisms, wherein the controller is structured to selectively control each adjustment carried out by the number of adjustment mechanisms.

10. The can bodymaker of claim 9, wherein the adjustment arrangement further comprises a sensing arrangement in communication with the controller, wherein the sensing arrangement includes a number of sensors structured to detect the position of a number of components of the bodymaker, and wherein the controller is structured to selectively control each adjustment carried out by the number of adjustment mechanisms based at least in part from input received from the number of sensors.

11. The can bodymaker of claim 8, wherein the number of adjustment mechanisms comprises a plurality of adjustment mechanisms.

12. The can bodymaker of claim 8, further comprising a cradle supporting the toolpack, wherein the number of adjustment mechanisms are coupled to the toolpack via the cradle.

13. The can bodymaker of claim 8, wherein the number of adjustment mechanisms are driven by one or more of a mechanical, pneumatic, electrical and/or a hydraulic means.

14. The can bodymaker of claim 11, wherein each adjustment mechanism of the plurality of adjustment mechanisms are driven by one or more of a mechanical, pneumatic, electrical and/or a hydraulic means.

* * * * *